US011389741B2

(12) United States Patent
Desforges et al.

(10) Patent No.: US 11,389,741 B2
(45) Date of Patent: Jul. 19, 2022

(54) TRANSFORMABLE BUILDING BLOCK

(71) Applicant: Mattel-MEGA Holdings (US), LLC, El Segundo, CA (US)

(72) Inventors: Éric Desforges, Montréal (CA); Dawn Elizabeth Pitcher Wintour, Montréal (CA); Etienne Carignan, Longueuil (CA); Thierry Beauregard, Boisbriand (CA)

(73) Assignee: Mattel-MEGA Holdings (US), LLC, El Segundo, CA (US)

( * ) Notice: Subject to any disclaimer, the term of this patent is extended or adjusted under 35 U.S.C. 154(b) by 311 days.

(21) Appl. No.: 16/704,073

(22) Filed: Dec. 5, 2019

(65) Prior Publication Data

US 2020/0188806 A1 Jun. 18, 2020

Related U.S. Application Data

(60) Provisional application No. 62/778,577, filed on Dec. 12, 2018.

(51) Int. Cl.

| | |
|---|---|
| ***A63H 33/04*** | (2006.01) |
| ***A63H 33/00*** | (2006.01) |
| ***A63H 33/08*** | (2006.01) |

(52) U.S. Cl.

CPC ..... *A63H 33/042* (2013.01); *A63H 33/003* (2013.01); *A63H 33/086* (2013.01); *A63H 33/088* (2013.01)

(58) Field of Classification Search

CPC .. A63H 33/003; A63H 33/042; A63H 33/086; A63H 33/088

USPC ... 446/72, 97, 101, 102, 104, 308, 309, 311, 446/312, 330

See application file for complete search history.

(56) References Cited

U.S. PATENT DOCUMENTS

| | | | | | |
|---|---|---|---|---|---|
| 1,585,887 | A | * | 5/1926 | Beach | A63H 13/16 446/310 |
| 1,615,925 | A | * | 2/1927 | Yancey | A63H 3/12 446/310 |
| 2,646,646 | A | * | 7/1953 | Glass | A63H 33/00 446/310 |
| 2,960,794 | A | | 11/1960 | Johns | |
| 2,968,121 | A | * | 1/1961 | Pearson, Jr. | A63H 37/00 446/177 |
| 3,106,397 | A | | 10/1963 | Lacey | |
| 3,982,353 | A | | 9/1976 | Christiansen | |
| 4,226,045 | A | * | 10/1980 | Lehmann | A63H 3/00 446/101 |
| 4,571,199 | A | * | 2/1986 | Murakami | G04B 37/0008 446/135 |
| 5,019,010 | A | * | 5/1991 | Nikaido | A63H 33/003 446/230 |
| 5,046,983 | A | | 9/1991 | Suzuki | |
| 5,411,428 | A | | 5/1995 | Orii et al. | |

(Continued)

*Primary Examiner* — Joseph B Baldori

(74) *Attorney, Agent, or Firm* — Plumsea Law Group, LLC

(57) ABSTRACT

A transformable building block comprises a body configured to receive a connector post or other portion of another building element, an appendage movably coupled to the body, and a post configured to protrude from the body and retract into the body. Inserting a connector post into the body of the transformable building block may cause the appendage to move and the post to protrude from the body. Removing the connector post from the body may cause the post to retract into the body.

20 Claims, 16 Drawing Sheets

(56) References Cited

U.S. PATENT DOCUMENTS

| | | | | |
|---|---|---|---|---|
| 5,419,730 | A | 5/1995 | Diresta et al. | |
| 5,427,558 | A * | 6/1995 | Knudsen | A63H 33/042 446/102 |
| D390,293 | S | 2/1998 | Pardorf et al. | |
| 5,857,892 | A | 1/1999 | Leadbetter | |
| 6,609,944 | B1 | 8/2003 | Viola | |
| D609,290 | S | 2/2010 | Oblack et al. | |
| 7,785,168 | B2 | 8/2010 | Yamada et al. | |
| 8,033,892 | B2 * | 10/2011 | Stubenfoll | A63H 33/06 446/486 |
| D675,679 | S | 2/2013 | Soriano et al. | |
| 8,517,791 | B2 * | 8/2013 | Yamada | A63H 33/003 446/310 |
| 8,920,207 | B2 | 12/2014 | Hageman et al. | |
| 9,433,871 | B2 | 9/2016 | Park | |
| 9,814,997 | B1 | 11/2017 | Vaillancourt et al. | |
| 9,943,771 | B2 | 4/2018 | Blow | |
| 10,195,539 | B2 | 2/2019 | Vaillancourt et al. | |
| 2019/0118108 | A1 | 4/2019 | Vaillancourt et al. | |

* cited by examiner

TRANSFORMABLE BUILDING BLOCK

CROSS-REFERENCE TO RELATED APPLICATION(S)

This application claims the benefit of U.S. Provisional Application No. 62/778,577, filed Dec. 12, 2018, which is herein incorporated by reference in its entirety.

BACKGROUND

Field

The present embodiments relate generally to toys, and in particular, to building blocks and modular play structures.

Background

Popular toys for children are building blocks that can be connected together to create different objects and structures. Though some objects and structures may be assembled from a single type of building block, providing a child with additional options and possibilities of play through an assortment of different building blocks and other building elements is highly desirable.

SUMMARY

A transformable building block is described herein, which may be stacked onto connector posts, or other portions, of an associated building block system, and may allow additional building blocks or elements to be built on top of the transformable building block. When the transformable building block is stacked onto a connector post, an internal mechanism may open or move various appendages and raise a top post from inside the transformable building block (i.e., engaged configuration). The now protruding top post may allow other building blocks to be connected with the transformable building block. Additionally, when the transformable building block is stacked onto a connector post, a child's hand may keep one or more of the appendages closed or retracted in the transformable building block. A clutch or spring load allows the appendages to be closed when held down by an external force and automatically open when released.

When the transformable building block is removed from the connector post, the internal mechanism may close or retract the appendages and top post back into, or against, the transformable building block (i.e., default configuration). In one or more embodiments, the transformable building block may collapse into a substantially spherical shape. While in its substantially spherical configuration, the retracted appendages may allow the transformable building block to roll conveniently down a track or ramp.

In transforming from the default configuration to the engaged configuration, movement of one or more appendages may reveal features of a transformable building block. In an embodiment, two appendages may open to reveal two eyes. In another embodiment, one or more appendages may reveal a face or expression. In another embodiment, one or more appendages may cycle between the default and engaged configurations, opening and closing to provide a "peek-a-boo" function.

In one embodiment, a transformable building block may comprise a body configured to receive a connector post, an appendage movably coupled to the body, and a post configured to protrude (e.g., slidably) from the body and retract into the body. Inserting a connector post into the body of the transformable building block may cause the appendage to move and the post to protrude from the body. Removing the connector post from the body may cause the post to retract into the body. In one or more embodiments, the transformable building block may have a substantially spherical shape when the body has not received a connector post.

In another aspect, removing the connector post from the body may cause the post to retract into the body.

In another aspect, the transformable building block may have a substantially spherical shape when the body has not received a connector post.

In another aspect, the transformable building block may further include a base plate and a central plate. The base plate may be in contact with the post and may be configured to be pushed by the connector post to move the post from a default configuration of the transformable building block in which the post is disposed inside the body to an engaged configuration of the transformable building block in which the post protrudes from the body. The central plate may be movably coupled to the body and connected to the appendage, and as the post moves toward the engaged configuration, the base plate may push the central plate, and the central plate may move the appendage.

In another aspect, the post may move in a first direction from the default configuration to the engaged configuration, the central plate may move in a second direction transverse to the first direction, and the base plate may move the central plate in the second direction as the post moves from the default configuration to the engaged configuration.

In another aspect, the base plate may have an angled rib that slides against a sliding member of the central plate and progressively moves the sliding member in the second direction as the post moves in the first direction.

In another aspect, the central plate may be connected to the appendage by a spring biased to pull the appendage against the body. In the default configuration, the appendage may be stowed against the body. Movement of the central plate in the second direction transverse to the first direction may pull the appendage against the spring to a position protruding from the body, in the engaged configuration.

In another aspect, removing the connector post from the body may cause the spring to pull the appendage and the central plate toward the default configuration, and the central plate may move the post toward the default configuration.

In another aspect, the transformable building block may include a return spring connected to the central plate and the body, and biased to pull the central plate to the default configuration.

In another aspect, the body may define a cavity that receives the connector post, a wall of the cavity may define an opening, the central plate may protrude from the opening, and the central plate may be configured to contact the connector post as the connector post is received within the cavity such that the connector post pushes the central plate in the second direction toward the engaged configuration.

In another aspect, the central plate may have a leg that protrudes from the opening, and the leg may have an angled surface configured to slide against a corresponding angled surface of the connector post.

In another aspect, the base plate may have a base, the base may define an opening, and the central plate may extend through the opening of the base and then protrude from the opening of the wall of the cavity.

In another aspect, the body may include a first section and a second section. The first section and the second section may be joined along curved and flanged joints, and may have edges that define a recess of the body. In the default configuration, the appendage may be stowed within the recess substantially flush with an outer surface of the body.

In another aspect, the body may define a guide member, and the central plate may have a runner member that protrudes in the first direction and slides against the guide member.

In another embodiment, a transformable building block may comprise a body defining a storage cavity and a receiving cavity, a post member having a protruding portion and a base portion, and being movably coupled to the body to move in a first direction, a central plate moveably coupled to the body to move in a second direction transverse to the first direction, and an appendage moveably coupled to the body and connected to the central plate. In a default configuration of the transformable building block, the protruding portion may be disposed in the storage cavity, the base portion may be disposed within the receiving cavity at a first position, the central plate may be disposed at a first inner position, and the appendage may be stowed against the body. In moving from the default configuration to an engaged configuration of the transformable building block, the protruding portion may protrude from the storage cavity, the base portion may move within the receiving cavity to a second position farther inside the body than the first position, the central plate may be moved by the base portion to a second outer position outside of the first inner position, and the appendage may be moved by the central plate to protrude away from the body.

In another aspect, the base portion of the post member may have a base disposed in the receiving cavity and a riser extending from the base to the protruding portion and extending through an opening of the body.

In another aspect, as the base portion moves from the first position to the second position, the base portion may push the central plate from the first inner position to the second outer position.

In another aspect, the body may define an opening in a wall of the receiving cavity, and a portion of the central plate may extend through the opening in the wall and into the receiving cavity, and may be configured to be pushed in the second direction by a portion of another building element inserted into the receiving cavity.

In another aspect, the appendage may be connected to the central plate by a spring that is biased to pull the appendage stowed against the body.

In another embodiment, a transformable building block may comprise a body, a post member, a central plate, and an appendage. The post member may have a base portion and a post portion. The post member may be movably coupled to the body to move along a first axis between a default position in which the post portion is disposed inside the body and an engaged position in which the post portion protrudes from the body. The central plate may be movably coupled to the body to move along a second axis that is transverse to the first axis between a first inner position and a second outer position. The appendage may be connected to the central plate. As the post member moves from the default position to the engaged position, the base portion of the post member may force the central plate from the first inner position to the second outer position. As the central plate moves from the first inner position to the second outer position, the central plate may move the appendage from a first stowed position to a second protruding position.

Other objects, features, and advantages of the present embodiments will become apparent to those skilled in the art from the following detailed description. It is to be understood, however, that the detailed description and specific examples, while indicating some embodiments, are given by way of illustration and not limitation. Many changes and modifications within the scope of the present embodiments may be made without departing from the spirit thereof, and the present embodiments include all such modifications.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Embodiments provide a transformable building block that when stacked onto another building element of an associated building block system, may transform from a default configuration with a post stored and an appendage stowed, to an engaged configuration with the post and the appendage protruding, and in the engaged configuration may allow additional building blocks or elements to be built on of the transformable building block.

Figure 2:
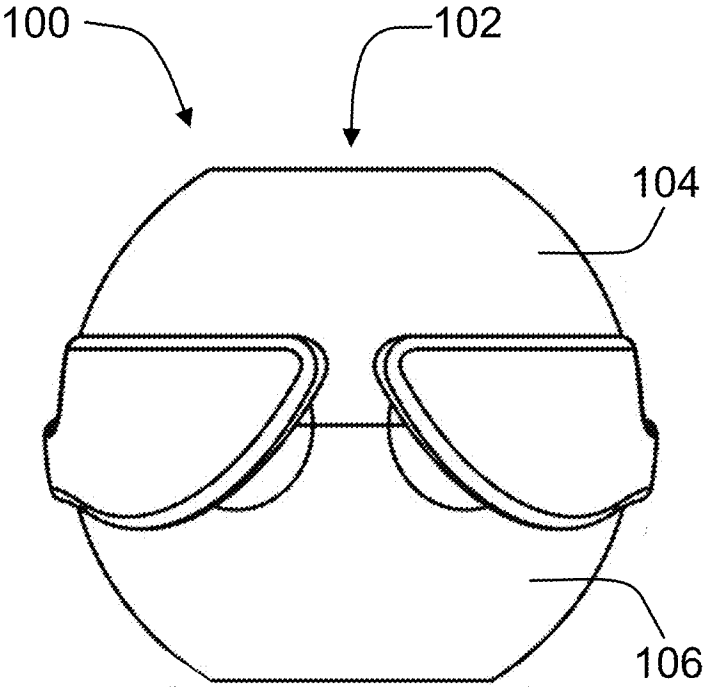
FIG. 2 is a schematic diagram that illustrates a front view of the transformable building block of FIG. 1 in the default configuration, in accordance with an embodiment.
Figure 1:
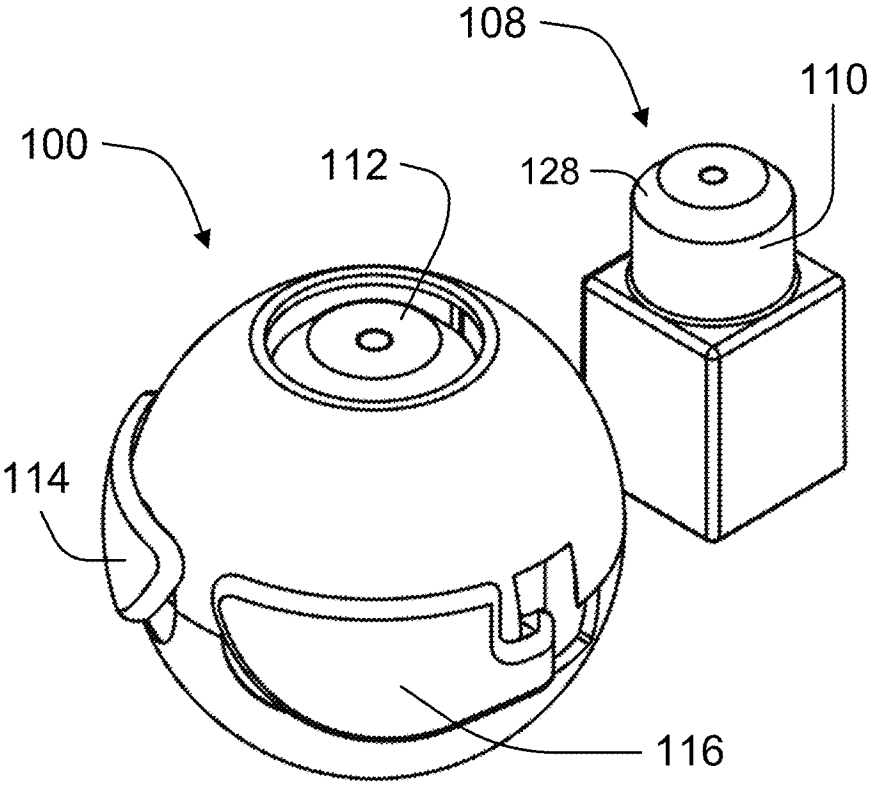
FIG. 1 is a schematic diagram that illustrates a perspective view of a transformable building block and a typical building block, in accordance with an embodiment.

Referring to FIGS. 1 and 2, an illustrative embodiment of the transformable building block is shown. In preferred embodiments, the transformable building block 100 may have a substantially spherical body 102 formed by a top section 104 and a flat bottom section 106. The outer portions of the top section 104 and the bottom section 106 may have flat geometries (see, e.g., FIG. 2), which may allow the transformable building block 100 to contact and securely engage flat surfaces of other building blocks or building elements in a toy construction assembly. The bottom section 106 of the body 102 may include an opening, aperture, and/or cavity that is sized to receive a connector post, or other portion, of another building block or building element (see, e.g., FIG. 8A). For example, FIG. 1 shows a typical simple building block 108 with a connector post 110 that may be used to engage the bottom section 106 of the transformable building block 100, with flat lower surfaces of the bottom section 106 contacting flat upper surfaces of the building block 108. The top section 104 of the body 102 may also include an opening, aperture, and/or cavity that is sized to allow a top post 112 stored within the body 102 of the transformable building block 100 to pass through the body 102 and protrude from the transformable building block 100. Two appendages 114, 116 may also be movably coupled to the body 102 of the transformable building block 100. Appendages 114, 116 may represent, for example, ears, wings, hands, and/or arms.

In FIGS. 1 and 2, the transformable building block 100 is shown in its default configuration in which the transformable building block 100 has not been connected to or engaged with another building block or element. In this configuration, the appendages 114, 116 may be closed around, or stowed against, the body 102 such that the transformable building block 100 retains its substantially spherical shape. The top post 112 may also be stored within the cavity of the body 102, with an upper surface of the top post 112 flush with or recessed from the upper surface of the top section 104, for example, as seen from the front view of FIG. 2. The substantially spherical shape of the transformable building block 100 may allow the transformable building block 100 to roll, for example, down a ramp or across a flat surface (see, e.g., FIG. 8B). Though the transformable building block 100 is illustrated herein as having a substantially spherical shape, embodiments of the transformable building block 100 may include other shapes, such as a cube, cylinder, cone, prism, or pyramid.

Figure 3B:
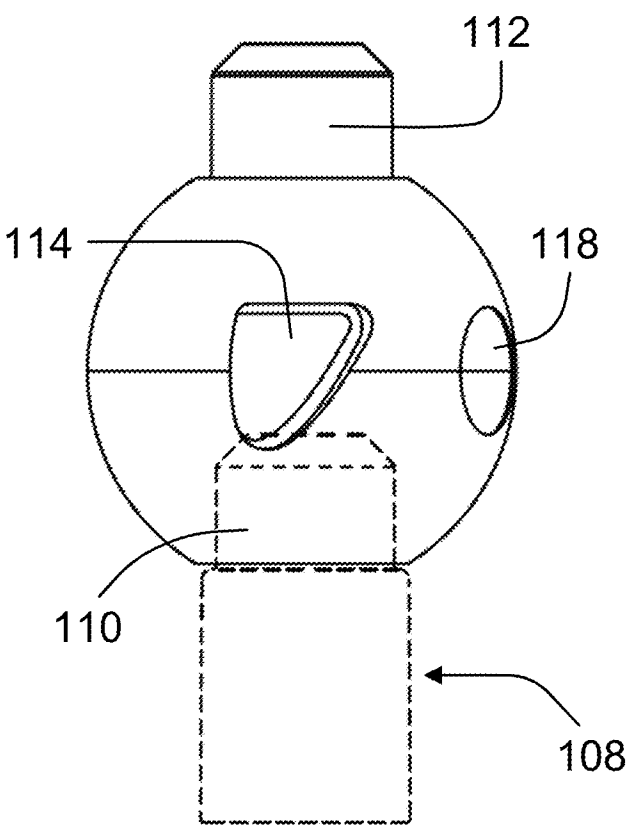
FIGS. 3A and 3B are schematic diagrams that illustrate a front view (FIG. 3A) and side view (FIG. 3B) of the transformable building block of FIG. 1 in the engaged configuration, in accordance with an embodiment.
Figure 3A:
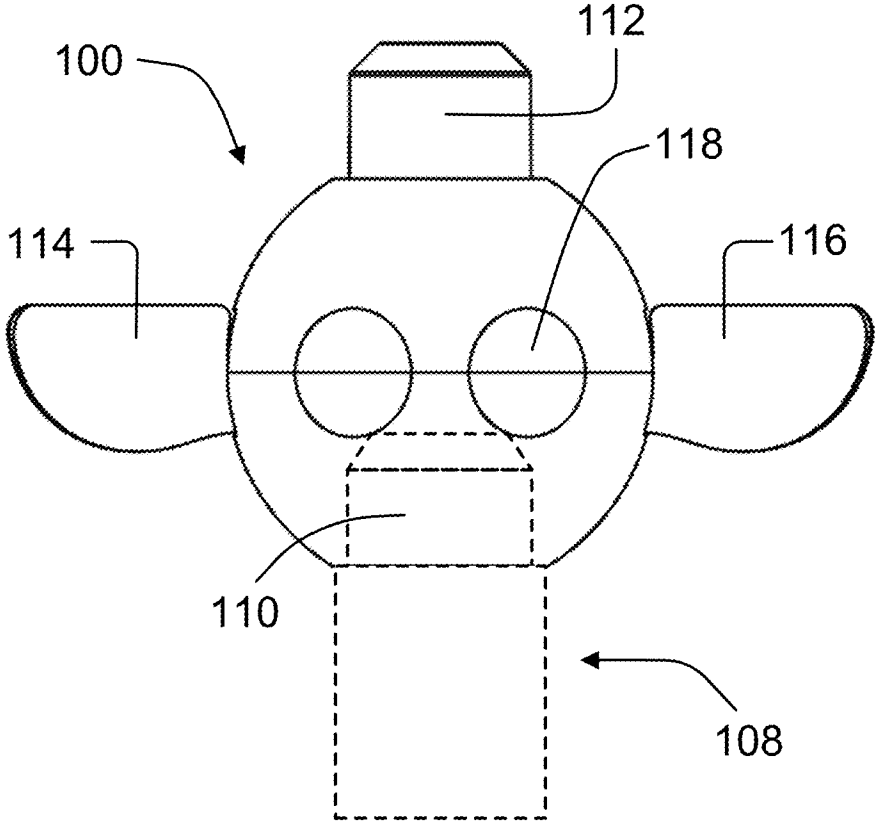

Referring now to FIGS. 3A and 3B, the transformable building block 100 is shown in its engaged configuration. The transformable building block 100 may transform from its default configuration (see, e.g., FIGS. 1 and 2) to its engaged configuration when the connector post 110 of another building block 108 (shown as a dashed outline) is inserted into the bottom section 106 of the transformable building block 100. Engagement of the connector post 110 of the building block 108 with the transformable building block 100 may cause the top post 112 to protrude from the top section 104 of the transformable building block 100. Preferably, the top post 112 is the same size and shape as the connector post 110 that is inserted into the transformable building block 100. This may allow an additional transformable building block, simple building block, or other building element to be stacked on top of the transformable building block 100. Stacking the transformable building block 100 onto the connector post 110 may also cause the two appendages 114, 116 to pivot outwardly from the body 102 of the transformable building block 100 and reveal features of the transformable building block 100, such as two eyes 118. In embodiments, cycling transformable building block 100 between the default and engaged configurations may open and close appendages 114, 116 to alternately conceal and reveal eyes 118, thereby providing a "peek-a-boo" function.

Figure 4B:
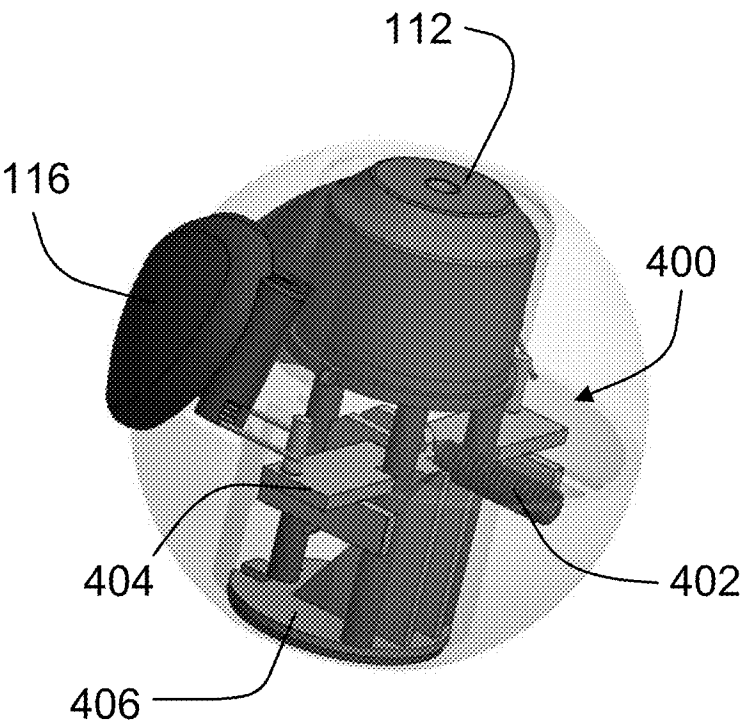
FIGS. 4A-4C are schematic diagrams that illustrate a front perspective view (FIG. 4A), a rear perspective view (FIG. 4B), and a cross-sectional view (FIG. 4C) of the internal components of a transformable building block in the default configuration, in accordance with another embodiment.
Figure 4A:
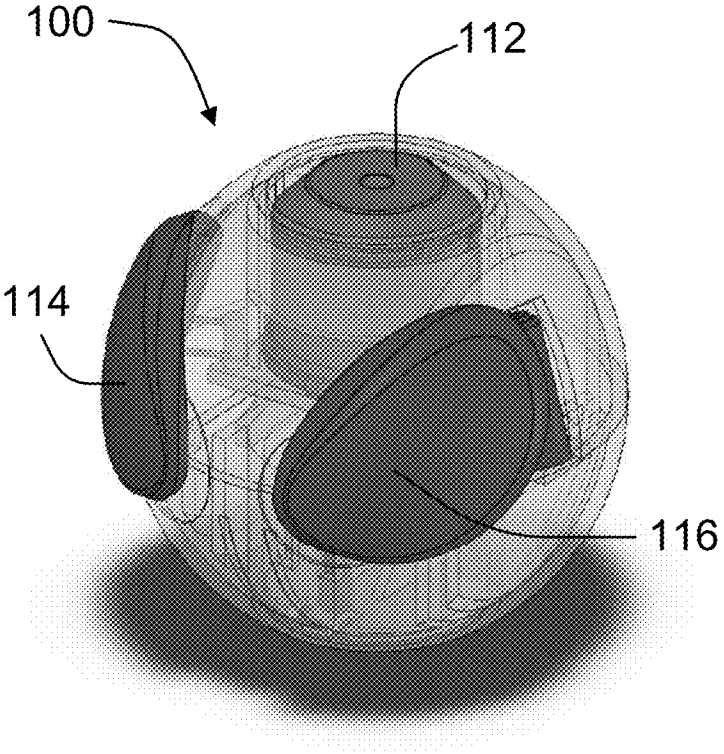
Figure 4C:
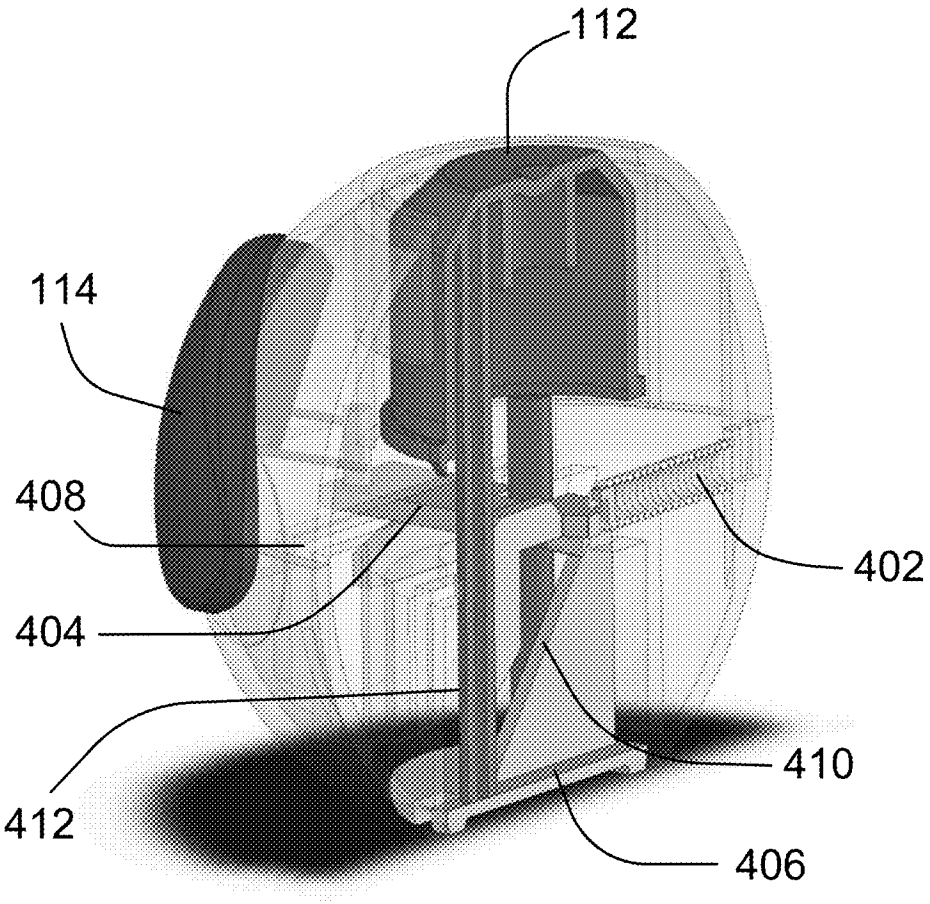

FIGS. 4A-4C show an exemplary embodiment of an internal mechanism 400 of the transformable building block 100. The internal mechanism 400 may include a central plate 404, a base plate 406, and a top post 112. The central plate 404 may be held in place by the body 102 and a spring 402 attached to the central plate 404. The body 102 may further include guides 408 against which the central plate 404 can slide. The spring 402, which may be referred to as a return spring, may bias the central plate 404 to the position shown in FIGS. 4A-4C. Appendages 114, 116 may also be movably connected to the central plate 404. The base plate 406 may include angled cam surfaces or ribs 410 that are matched to slide against the central plate 404. The base plate 406 may further support the top post 112, which may include one or more risers 412, which in this example are three risers. Together, the base plate 406 and the top post 112 may be collectively referred to as a post member.

FIGS. 5A-5D show the internal mechanism 400 of the transformable building block 100 in its engaged configuration. When a connector post is inserted into the bottom section 106 of the transformable building block 100, the base plate 406 may be pushed up towards the top section 104. The upward movement of the base plate 406 may cause the angled ribs 410 of the base plate 406 to slide against the central plate 404, which may move the central plate 404 forward laterally in a direction away from the spring 402 (and against the biasing force of the spring 402). The guides 408 may ensure that the central plate 404 slides laterally along a predetermined path.

Because the top post 112 is supported by the base plate 406 (which may be referred to collectively as the post member), the top post 112 may rise in direct relation to the upward movement of the base plate 406. Here, the travel of the top post 112 is the height of a connector post inserted into the bottom section 106 of the transformable building block 100. The base plate 406 may be configured such that it abuts against the bottom section 106 or the central plate 404 when the base plate 406 is raised to a certain point. The top post 112 may also include a lip 414 that abuts against the edge of the opening of the top section 104, which prevents the top post 112 from being over-extended from the transformable building block 100.

Movement of the central plate 404 may also cause the appendages 114, 116 to move. Each appendage 114, 116 may include a torsion spring 416 that is operably connected to a protrusion 418 on the central plate 404. As the central plate 404 moves forward, the protrusion 418 may cause the torsion spring 416 to pivot a respective appendage 114, 116 away from the body 102 of the transformable building block 100. The torsion spring 416 may further allow an external force (e.g., a child's hand) to move the appendage 114, 116 back towards the body 102 while the transformable building block 100 is still in its engaged position. And, when such an external force is removed, the torsion spring 416 may again pivot the appendages 114,116 away from the body 102.

Disengaging the transformable building block 100 from an inserted connector post may allow the transformable building block 100 to transform back to its default configuration automatically. When an inserted connector post is removed, the spring 402 may pull the central plate 404 back to its default position (as shown in FIGS. 4A-4C). Movement of the central plate 404 towards the spring 402 may cause the base plate 406 to move downwards towards the bottom section 106 and the appendages 114, 116 to pivot back towards the body 102.

Figure 5B:
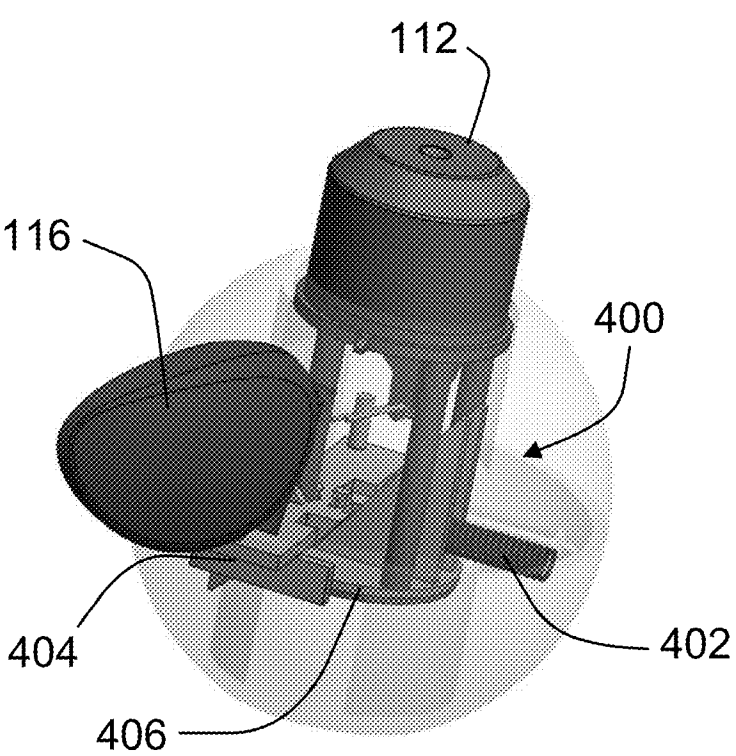
FIGS. 5A-5D are schematic diagrams that illustrate a front perspective view (FIG. 5A), a rear perspective view (FIG. 5B), a cross-sectional view (FIG. 5C), and a close-up partial view (FIG. 5D) of the internal components of the transformable building block of FIGS. 4A-4C in the engaged configuration, in accordance with an embodiment.
Figure 5A:
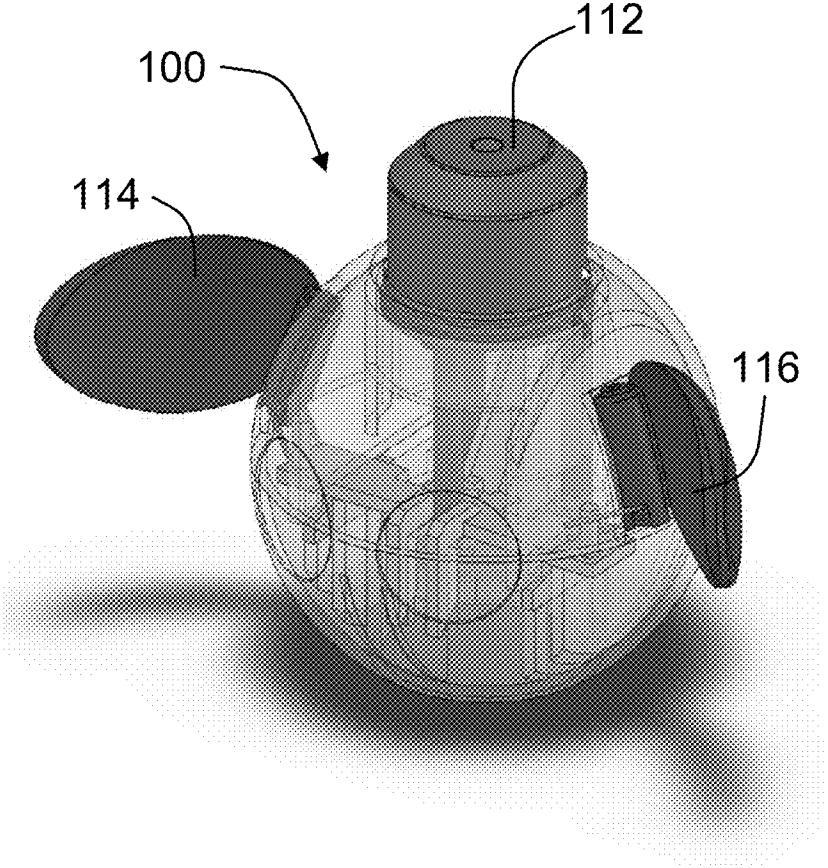
Figure 5D:
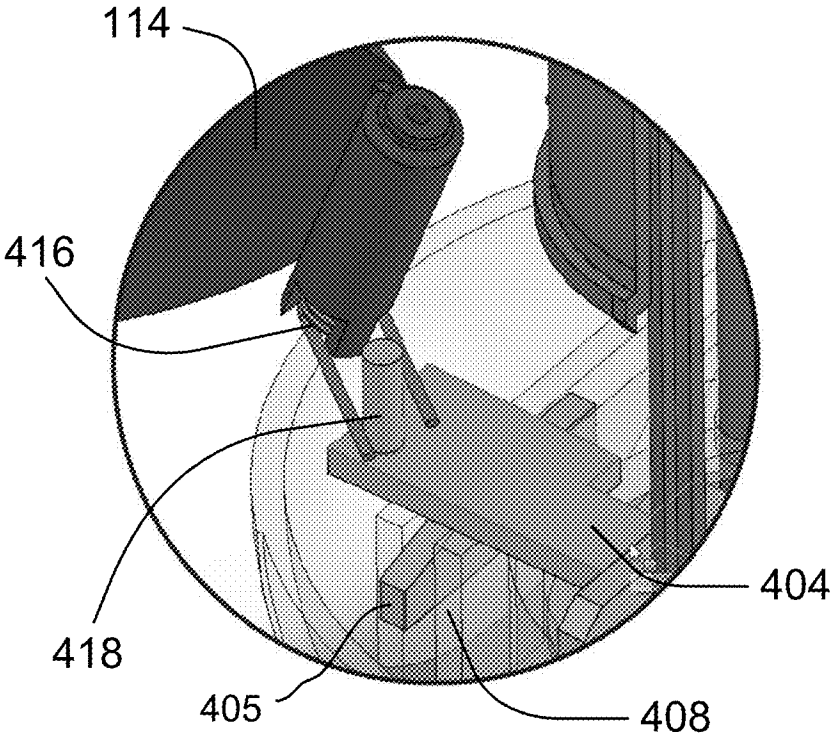
Figure 5C:
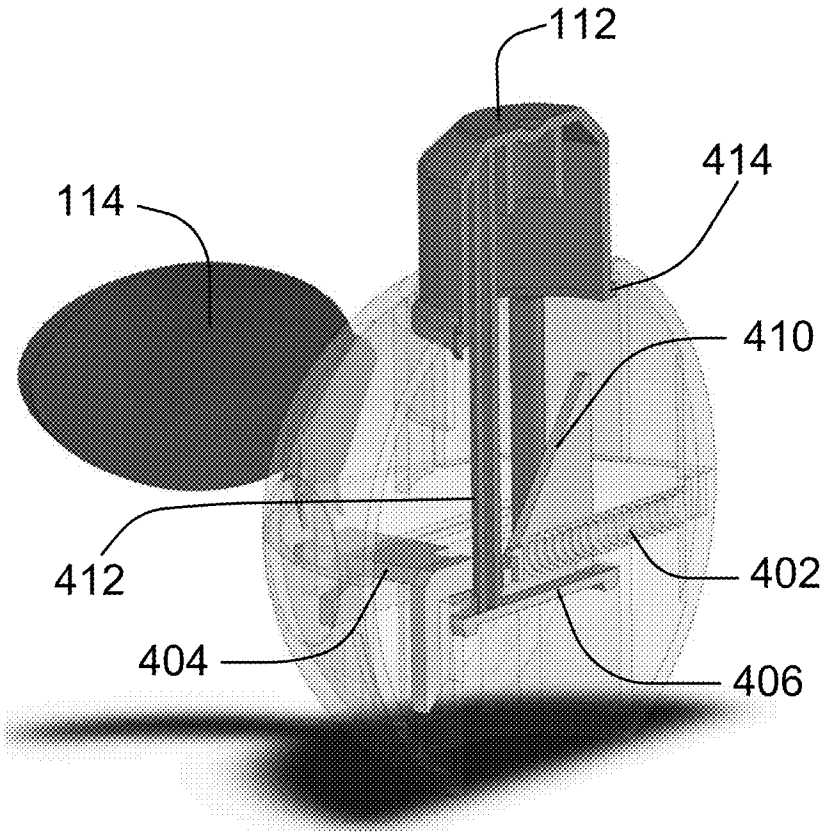
Figure 6:
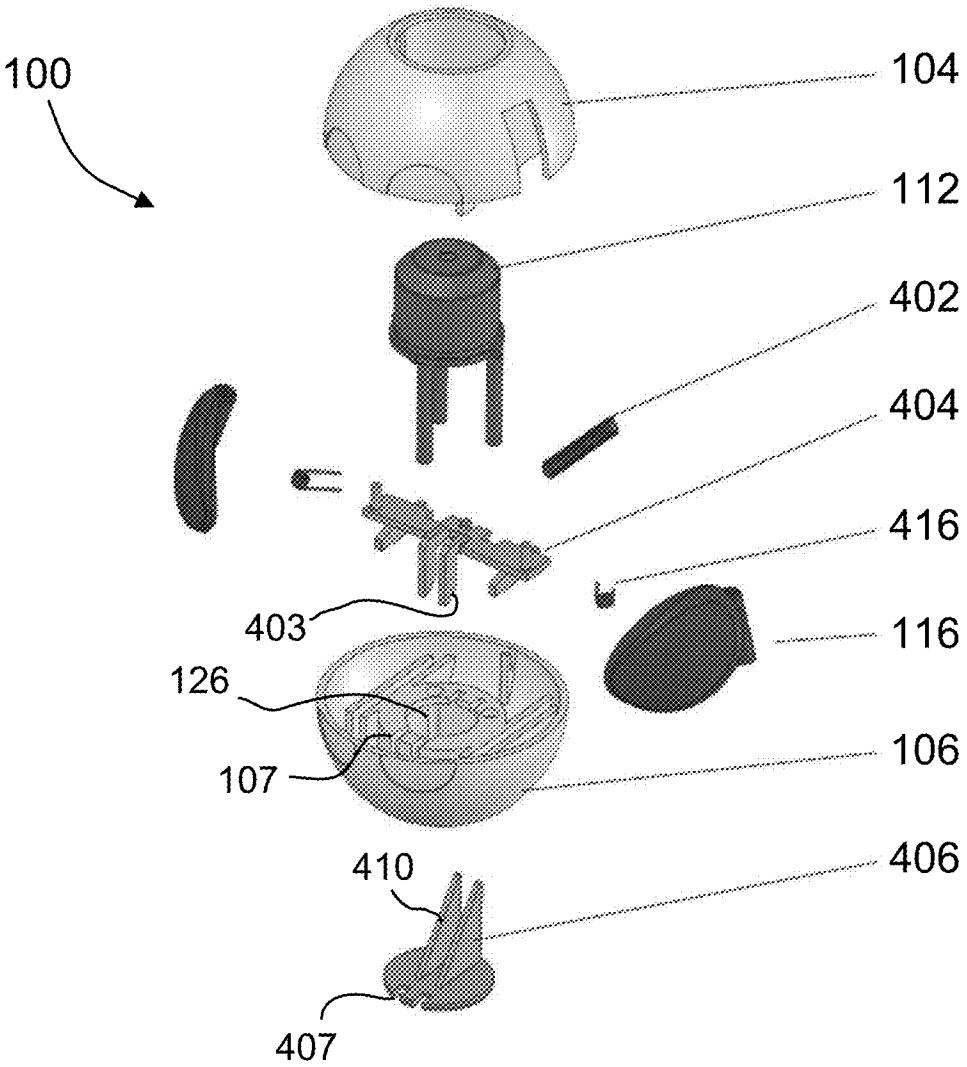
FIG. 6 is a schematic diagram that illustrates an exploded view of components of the transformable building block of FIGS. 4A-4C, in accordance with an embodiment.

FIG. 6 provides an exploded view of the components of an illustrative embodiment of the transformable building block 100. As shown, the body 102 of the transformable building block 100 may include a top section 104 and a bottom section 106. The bottom section 106 may include an opening (not shown) similar to the opening on the top section 104. The bottom section 106 may be molded with guides 408 to guide the lateral movement of a central plate 404. Central plate 404 may include runners 405 that contact guides 408, and which may be disposed between guides 408, as shown in the example of FIG. 5D. The bottom section 106 may be further molded with slots that allow the angled ribs 410 of a base plate 406 to move upwards past the central plate 404. The base plate 406 may support a top post 112, and together, the base plate 406 and the top post 112 may form a post member. The top post 112 may include risers 412 that pass through holes in the bottom section 106 to contact or connect to the base plate 406. A spring 402 may bias the central plate 404 to a default configuration. Appendages 114, 116 may be connected to the central plate 404 via torsion springs 416.

In addition to pushing central plate 404 with the angled ribs 410 of the base plate 406, embodiments may include provisions for allowing another building element to contact and push the central plate 404. As shown in FIG. 6, central plate 404 may have one or more legs 403, which may extend through one or more openings 107 of the bottom section 106 and one or more openings 407 of the base plate 406. In a default configuration, the one or more legs 403 may therefore extend inside the cavity 126 defined by bottom section 106. In an embodiment, as a post of another building element is received within the cavity 126, a surface of the post may push the legs 403 forward laterally in a direction away from the spring 402 to help move central plate 404 that same direction. As shown in FIG. 6, the legs 403 may also have angled lower surfaces, which may contact and slide against corresponding angled surfaces of another building element, such as the chamfered upper surface 128 of the building block 108 shown in FIG. 1.

In addition to the exemplary embodiment shown in FIGS. 1-6, a transformable building block may have other designs, shapes, and/or movable appendages. For instance, the transformable building block may be based on various themes and animals, such as an owl, penguin, bear, cow, cat, tiger, fox, dog, and elephant. The transformable building block may also have various appendages (wings, arms, ears, etc.) that open or move when the transformable building block is stacked on a connector post of a building block or special dedicated base. A lever may be pushed to release the transformable building block from the special dedicated base. When the transformable building block is removed from the post, the appendages may close or retract into the transformable building block automatically.

Figures 7A, 7B, 7C, 7D:
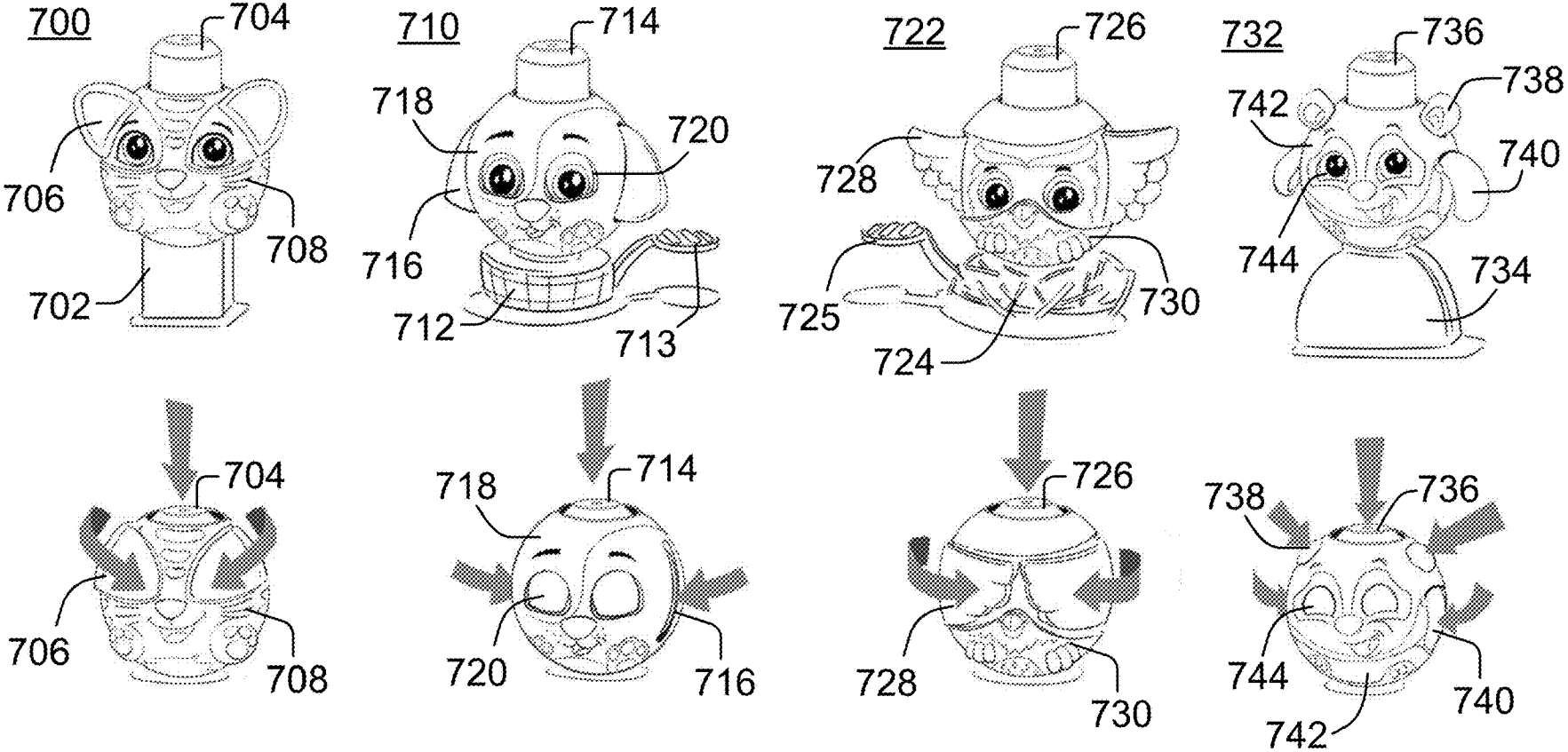
FIGS. 7A-7D are schematic diagrams that illustrate various embodiments of transformable building blocks transforming from engaged configurations to default configurations, in accordance with other embodiments.

FIGS. 7A-7D provide some illustrative embodiments of the transformable building block. For example, FIG. 7A shows a transformable building block 700 designed to represent a cat. In its engaged configuration (connected to base 702), the transformable cat block 700 may have a top post 704 that protrudes and ears 706 that are pivoted away from its body 708. In its default configuration (disengaged from base 702), the top post 704 may be retracted and the ears 706 may be pivoted towards its body 708, as represented by the arrows in FIG. 7A.

FIG. 7B shows a transformable building block 710 designed to represent a dog. In its engaged configuration (connected to base 712), the transformable dog block 710 may have a top post 714 and ears 716 that protrude from its body 718, and eyes 720 that are open. In its default configuration (disengaged from the base 712), the top post 714 and the ears 716 may be retracted into the body 718 and the eyes 720 may be closed, as represented by the arrows in FIG. 7B. The base 712 may further include a lever 713 that facilitates in releasing the transformable dog block 710 from the base 712. Pushing downwards on the lever 713 may force the transformable dog block 710 upwards and away from the base 712.

FIG. 7C shows a transformable building block 722 designed to represent an owl. In its engaged configuration (connected to base 724), the transformable owl block 722 may have a top post 726 that protrudes and wings 728 that are pivoted away from its body 730. In its default configuration (disengaged from base 724), the top post 726 may be retracted and the wings 728 may be pivoted towards its body 730, as represented by the arrows in FIG. 7C. The base 724 may also include a lever 725 that facilitates in releasing the transformable owl block 722 from the base 724.

FIG. 7D shows a transformable building block 732 designed to represent a bear. In its engaged configuration (connected to base 734), the transformable bear block 732 may have a top post 736, ears 738, and arms 740 that protrude from its body 742, and eyes 744 that are open. In its default configuration (disengaged from the base 734), the top post 736, ears 738, and arms 740 may be retracted into the body 742, and the eyes 744 may be closed, as represented by the arrows in FIG. 7D.

Figure 8B:
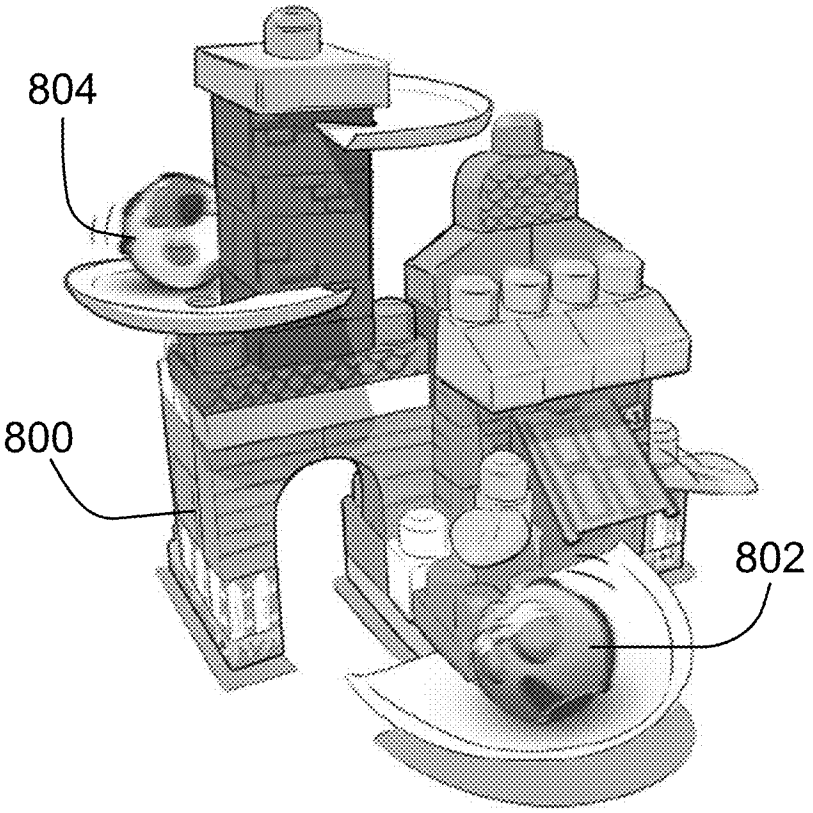
FIGS. 8A and 8B are schematic diagrams that illustrate various interactions between transformable building blocks and a play set, in accordance with other embodiments, with FIG. 8A showing the transformable building blocks in their engaged configurations while being stacked on the play set, and with FIG. 8B showing the transformable building blocks in their default configurations rolling across the play set.
Figure 8A:
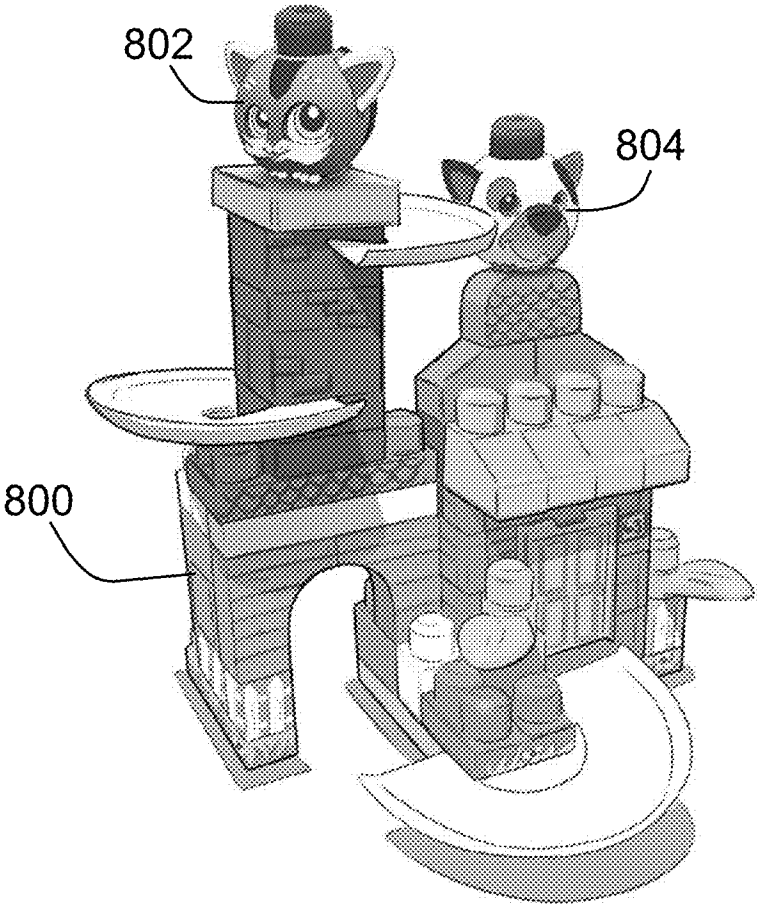

FIGS. 8A and 8B show transformable building blocks 802, 804 interacting with a constructed structure or play set 800, according to an embodiment. As shown in FIG. 8A, the transformable building blocks 802, 804 may be placed on various connector posts and in their engaged configurations. When removed from the connector posts, the transformable building blocks 802, 804 may assume their substantially spherical default configurations. This allows the transformable building blocks to roll down tracks or ramps in the play set 800, as shown in the example of FIG. 8B.

Figure 9:
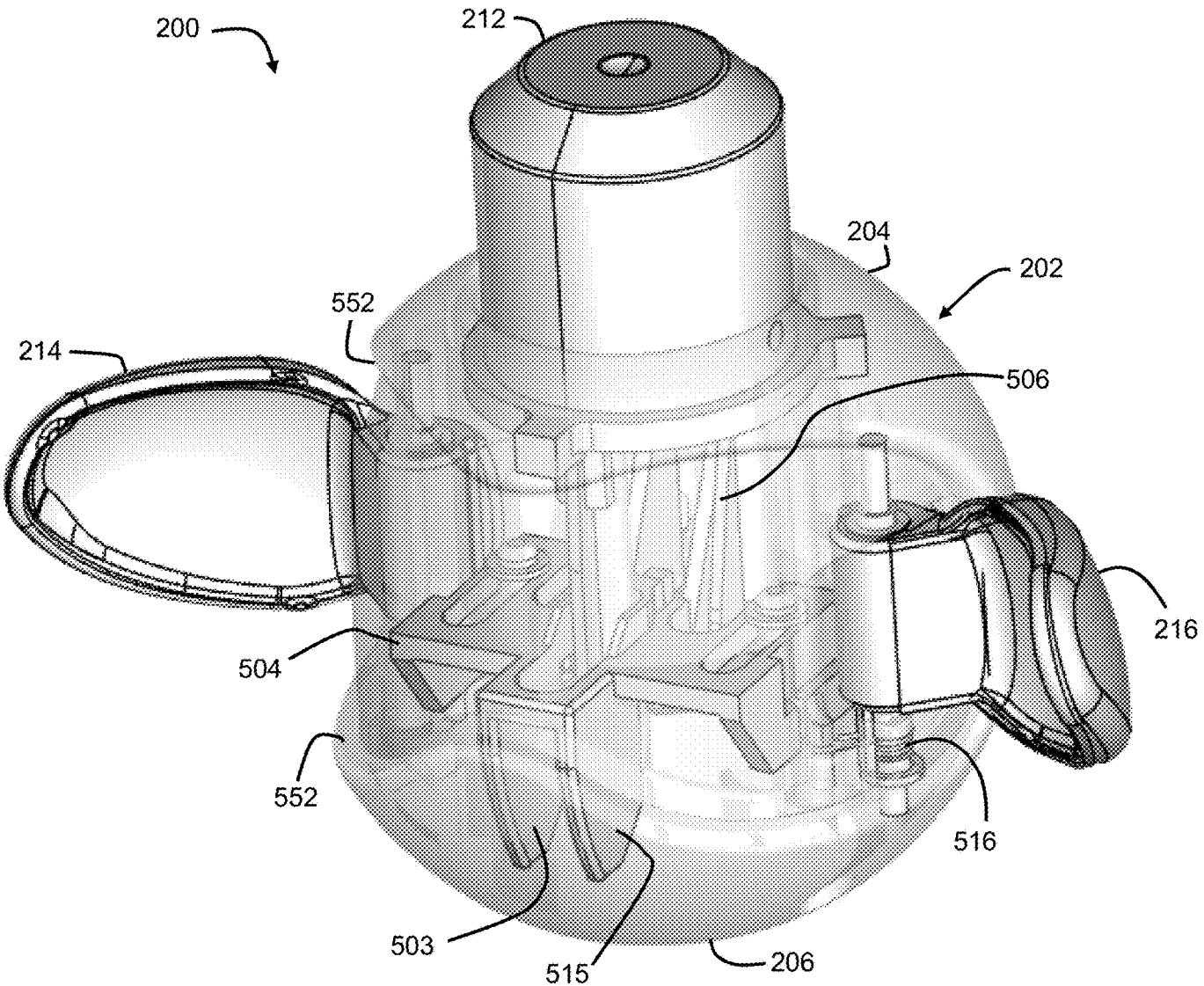
FIG. 9 is a schematic diagram that illustrates a front perspective view of a transformable building block, with the body shown transparent for illustrative purposes, in accordance with another embodiment.
Figure 10:
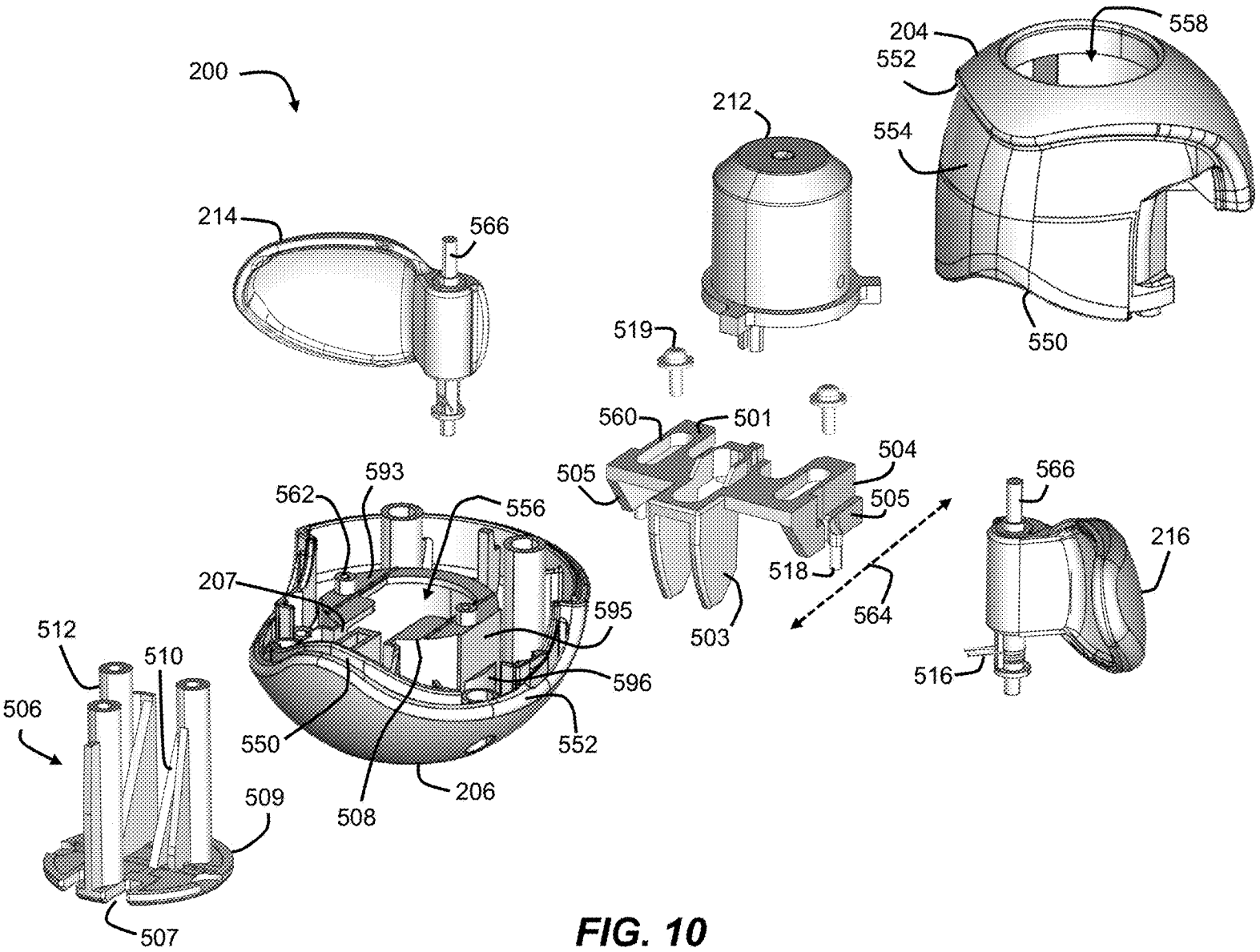
FIG. 10 is a schematic diagram that illustrates an exploded view of the components of the transformable building block of FIG. 9, in accordance with an embodiment.

Embodiments may also include further provisions for easing manufacture, increasing durability, and improving playability of a transformable building block. FIGS. 9-16 illustrate embodiments of such provisions, in an engaged configuration. As shown in FIGS. 9 and 10, an exemplary transformable building block 200 may have a substantially spherical body 202 formed by a top section 204 and a bottom section 206 (shown transparent in FIG. 9). The transformable building block 200 may further include one or more appendages 214, 216 (two in this embodiment), a post 212, a central plate 504, and a base plate 506. The two appendages 214, 216 may be movably coupled to the body 202 of the transformable building block 200, and may represent, for example, ears, wings, hands, and/or arms.

Post 212 may be connected to the base plate 506 at the top of one or more risers 512 of the base plate 506. Together, the post 212 and the base plate 506 may be collectively referred to as a post member. Central plate 504 may be disposed in between the post 212 and a guide support 508 of the bottom section 206. The base 509 of base plate 506 may be disposed on the other side of guide support 508, with the one or more risers 512 extending through openings in both the bottom section 206 and the central plate 504. The base 509 of base plate 506 may be configured to slide within a cavity 556 defined by the bottom section 206, and the base 509 and the cavity 556 may have complementary shapes and sizes, such as a cylindrical cavity having a first diameter and a circular base having a second diameter slightly smaller than the first diameter. The central plate 504 may be slidably secured to the bottom section 206 by fasteners 519 that extend through slots 560 of central plate 504 and are affixed to fastener openings 562 of the bottom section 206. As represented by the dashed arrow 564 in FIG. 10, central plate 504 may therefore slide forward (to the bottom left in FIG. 10) and backward (to the top and right in FIG. 10) over the guide support 508 of the bottom section 206 and within the bottom section 206.

The appendages 214, 216 may be pivotably connected to the body 102 by hinge assemblies 566. The insides of top section 204 and the bottom section 206 may define openings that receive the ends of the hinge assemblies 566. The appendages 214, 216 may be affixed and pivot with the hinge assemblies 566. The hinge assemblies 566 may also be attached to protrusions 518 of the central plate 504 by torsion springs 516. The torsion springs 516 may be biased in a direction that closes the appendages 214, 216 against the body 202 in the default configuration. Movement of the central plate 504 in the forward direction may cause the protrusions 518 to pull the torsion springs 516 against their bias, and pivot the appendages 214, 216 open to an engaged position (e.g., as shown in FIG. 10). Movement of the central plate 504 in the backward direction may cause the protrusions 518 to decrease tension on the torsion springs 516 and allow the appendages 214, 216 to pivot back closed to the default configuration. In embodiments, the torsion springs 516 may provide spring forces suitable for moving the central plate 504 and holding the appendages 214, 216 open, while also allowing the appendages 214, 216 to be closed manually (e.g., by a child's hand) when the central plate 504 is still in the forwardmost position. Providing such torsion springs may obviate the need for a counteracting spring pulling the central plate 504 in the rearward direction, such as the spring 402 of the embodiments of FIGS. 4A-6. Eliminating a counteracting spring may ease the manufacture of and increase the durability of a transformable building block.

As with the embodiment of FIGS. 4A-6 described above, the outer portions of the top section 204 and the bottom section 206 may have flat geometries, which may allow the transformable building block 200 to contact and securely engage flat surfaces of other building blocks or building elements in a toy construction assembly. Unlike the embodiment of FIGS. 4A-6, however, the top section 204 and the bottom section 206 of the body 202 may be joined along curved and flanged joints 550, which may overlap and provide a strong, durable connection between sections 204, 206. The top section 204 and the bottom section 206 may also include edges 552 that define one or more recesses 554 of the body 202. Recesses 554 may provide areas in which an appendage may stow, with the outer surface of the appendage substantially flush with the edges 552 so as to provide a substantially continuous spherical surface in a default configuration. The substantially spherical surface may improve the performance of a transformable building block in the default configuration, for example, allowing the block to roll more smoothly.

Figure 11:
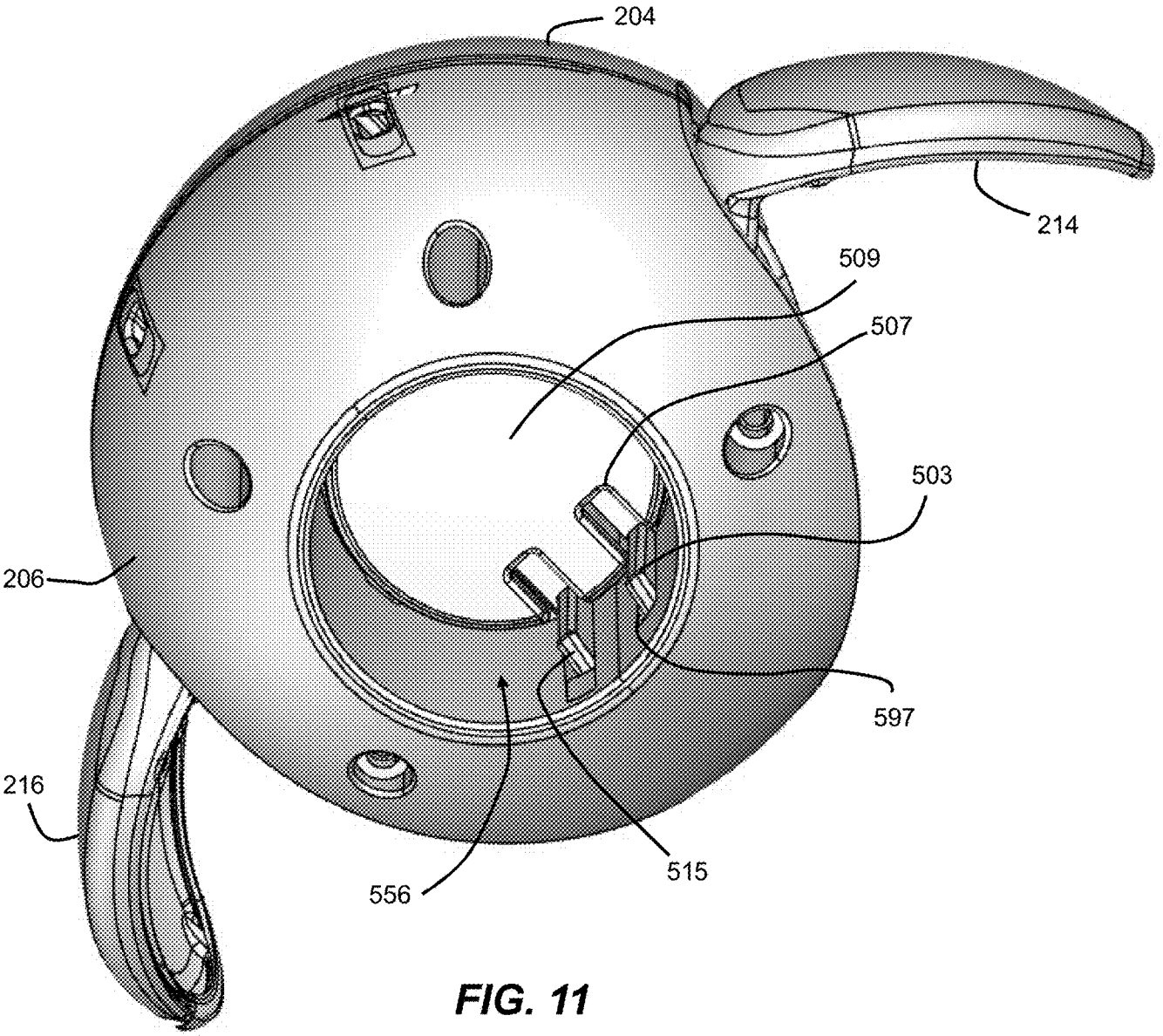
FIG. 11 is a schematic diagram that illustrates a bottom perspective view of the transformable building block of FIG. 9, in accordance with an embodiment.

As shown in FIGS. 10 and 11, the bottom section 206 of the body 202 may define an opening, aperture, and/or cavity 556 that is sized to receive a connector post, or other portion, of another building block or building element. The top section 204 of the body 202 may also include an opening, aperture, and/or cavity 558 that is sized to allow the post 212 to be stored within the body 202 of the transformable building block 200 and to emerge from the cavity 558 and protrude from the transformable building block 200.

Figure 12:
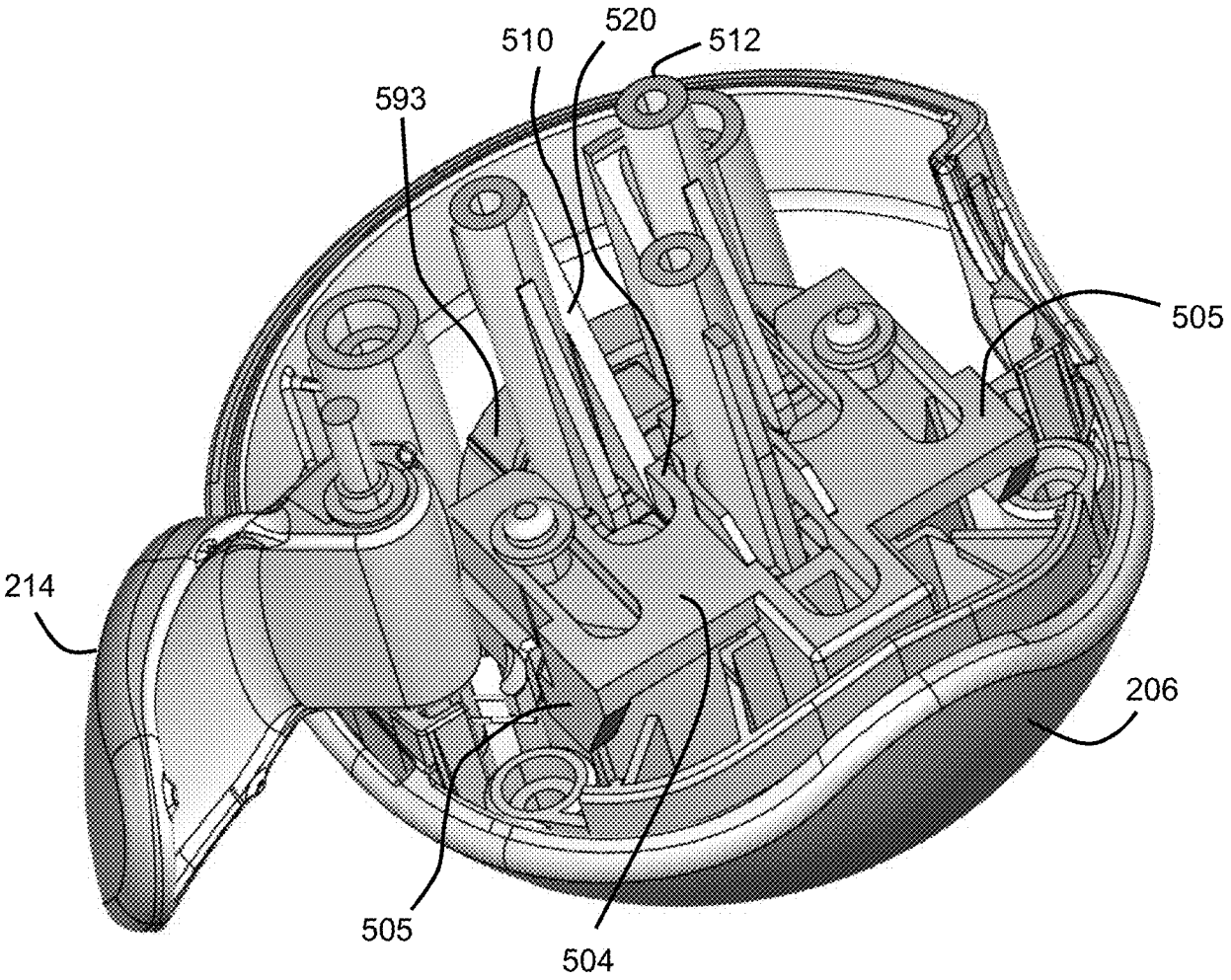
FIG. 12 is a schematic diagram that illustrates the transformable block of FIG. 9 with portions hidden for illustrative purposes, showing one appendage, the bottom section, the central plate, and the base portion of the post member, in accordance with an embodiment.
Figure 13:
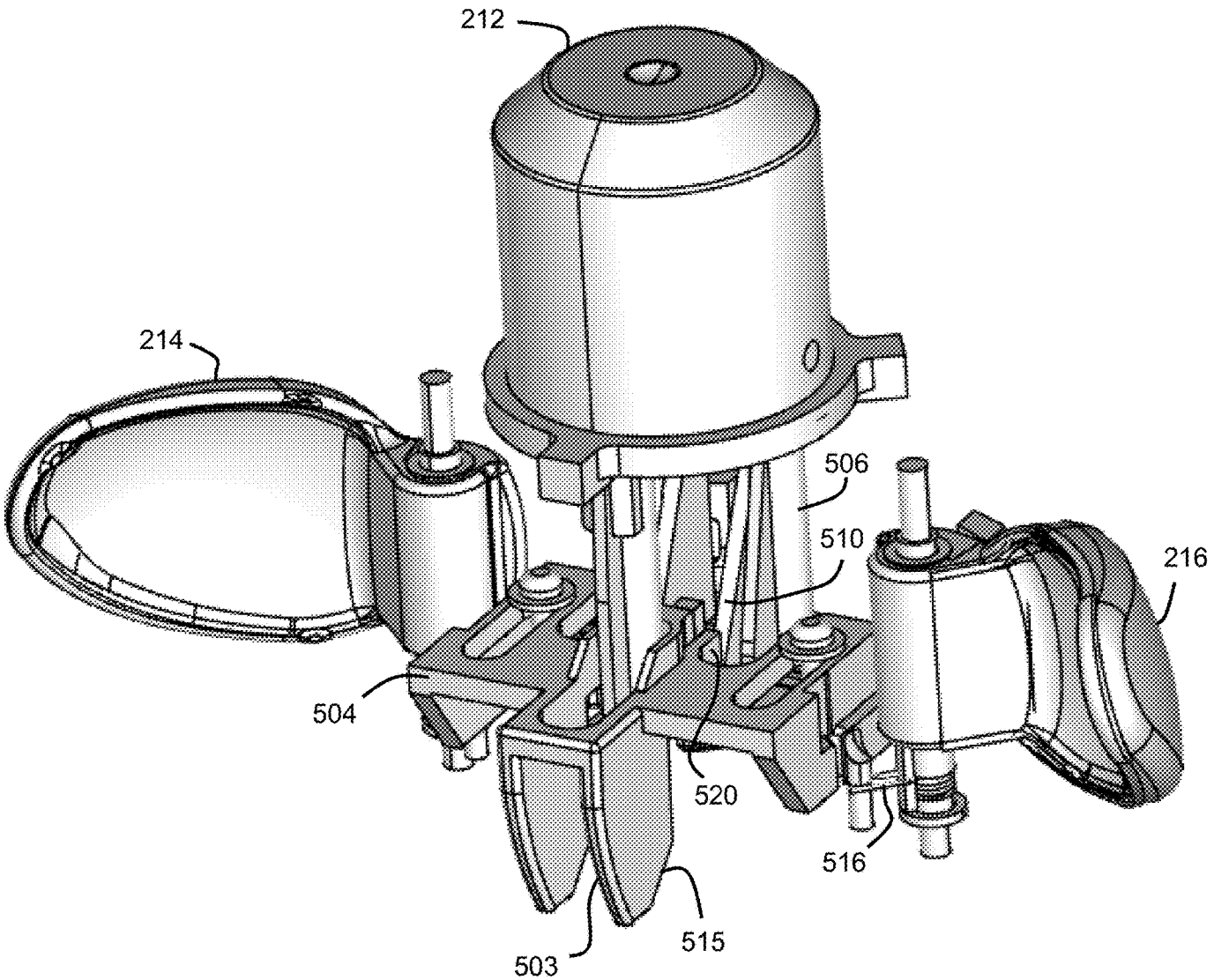
FIGS. 13 and 14 are a schematic diagrams that illustrate the transformable block of FIG. 9 with portions hidden for illustrative purposes, showing two appendages, the post member, and the central plate, in accordance with an embodiment.
Figure 14:
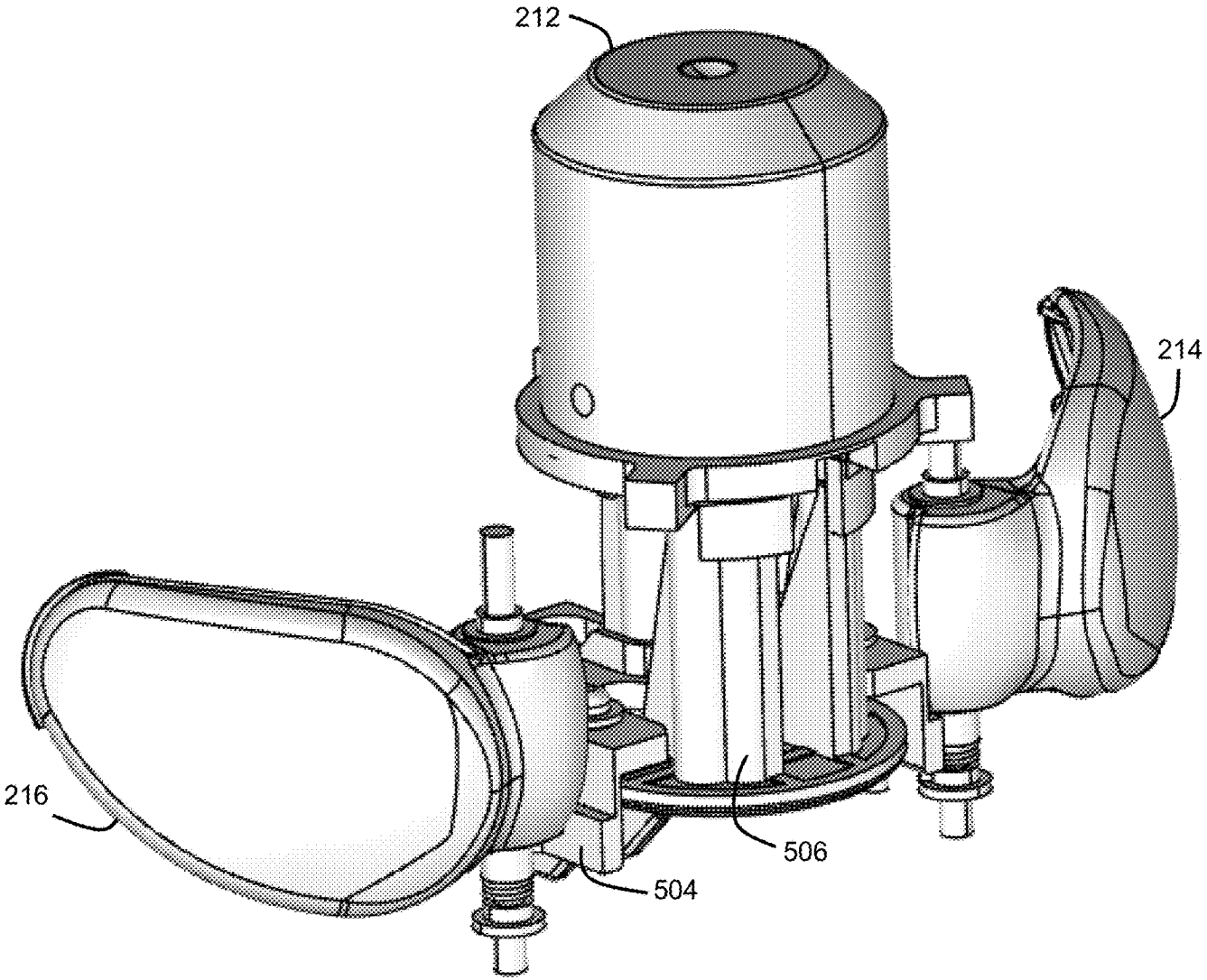
Figure 15:
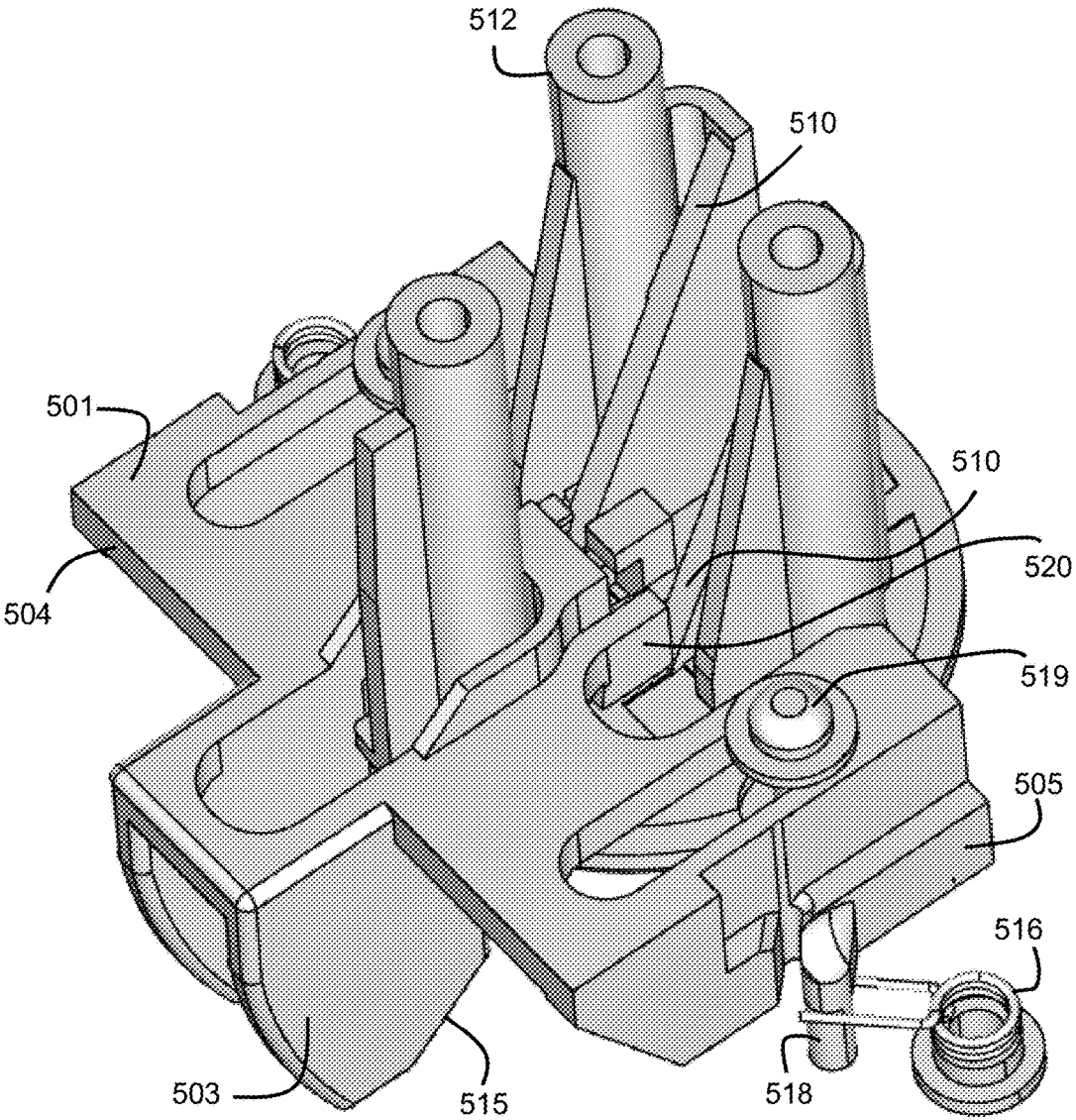
FIG. 15 is a schematic diagram that illustrates the transformable block of FIG. 9 with portions hidden for illustrative purposes, showing the central plate and portions of the appendages and post member, in accordance with an embodiment.

As shown in FIGS. 9, 10, and 12, the guide support 508 of bottom section 206 may guide the lateral movement of the central plate 504. Central plate 504 may include an upper portion 501 and two side portions 505 that contact and enclose an upper surface 593 and two side surfaces 595 of the guide support 508, as shown in the FIGS. 10, 12, and 15. The guide support 508 may also have side protrusions 596 over which the lower edges of the side portions 505 slide and are further supported. The bottom section 206 may be further molded with openings that allow the angled ribs 510 of a base plate 506 to move upwards past the central plate 504. The base plate 506 may include risers 512 that pass through holes in the bottom section 206 to contact or connect to the top post 212.

In embodiments, the transformable building block 200 may also include provisions for moving the central plate 504 in the forward direction while simultaneously extending the post 212, which may provide increased durability and smoother operation. As shown in FIGS. 9 and 10, the base plate 506 may be configured to push the post 212 upward while also pushing the central plate 504 forward. As the base plate 506 rises within the cavity 556, the post 212 also rises by virtue of the direct contact or connection through risers 512. At the same time, the angled ribs 510 of the base plate 506 slide against complementary slide members 520 of the central plate 504 and push the central plate 504 forward, as shown, for example, in FIGS. 12, 13, and 15. In addition, the base 509 of the base plate 506 may include one or more openings 507 through which legs 503 of the central plate 504 extend into the cavity 556, as shown in FIGS. 10 and 11. The central plate 504 may have one or more legs 503, which may extend through one or more openings 597 defined in a wall of the cavity 556 of the bottom section 206, and the one or more openings 507 of the base 509 of the base plate 506. In the default configuration, legs 503 may therefore extend inside the cavity 556 defined by the bottom section 206. In an embodiment, as a post of another building element is received within the cavity 556, a surface of the post may push the legs 503 forward to help move the central plate 504 forward. As shown in FIGS. 9-11, 13, and 15, the legs 503 may also have angled lower surfaces 515, which may contact and slide against corresponding angled surfaces of another building element, such as the chamfered upper surface 128 of the building block 108 shown in FIG. 1.

Although the disclosed embodiments are illustrated and described herein as embodied in one or more specific examples, it is nevertheless not intended to be limited to the details shown, since various modifications and structural changes may be made therein without departing from the scope of the present embodiments and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present embodiments to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment. Finally, various features from one of the embodiments may be incorporated into another of the embodiments.

The foregoing disclosure of the embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A transformable building block comprising:

a body configured to receive a connector post;

an appendage movably coupled to the body;

a post configured to protrude from the body and retract into the body, wherein inserting a connector post into the body causes the appendage to move and the post to protrude from the body;

a base plate in contact with the post and configured to be pushed by the connector post to move the post from a default configuration of the transformable building block in which the post is disposed inside the body to an engaged configuration of the transformable building block in which the post protrudes from the body; and a central plate movably coupled to the body and connected to the appendage, wherein as the post moves toward the engaged configuration, the base plate pushes the central plate and the central plate moves the appendage, wherein the post moves in a first direction from the default configuration to the engaged configuration, wherein the central plate moves in a second direction transverse to the first direction, and wherein the base plate moves the central plate in the second direction as the post moves from the default configuration to the engaged configuration.

2. The transformable building block of claim 1, wherein removing the connector post from the body causes the post to retract into the body.

3. The transformable building block of claim 1, wherein the transformable building block has a substantially spherical shape when the body has not received a connector post.

4. The transformable building block of claim 1, wherein the base plate has an angled rib that slides against a sliding member of the central plate and progressively moves the sliding member in the second direction as the post moves in the first direction.

5. The transformable building block of claim 1, wherein the central plate is connected to the appendage by a spring biased to pull the appendage against the body, wherein in the default configuration the appendage is stowed against the body, and wherein movement of the central plate in the second direction transverse to the first direction pulls the appendage against the spring to a position protruding from the body, in the engaged configuration.

6. The transformable building block of claim 5, wherein removing the connector post from the body causes the spring to pull the appendage and the central plate toward the default configuration, and wherein the central plate moves the post toward the default configuration.

7. The transformable building block of claim 5, further comprising a return spring connected to the central plate and the body, and biased to pull the central plate to the default configuration.

8. The transformable building block of claim 5, wherein the body defines a cavity that receives the connector post, wherein a wall of the cavity defines an opening, wherein the central plate protrudes from the opening, and wherein the central plate is configured to contact the connector post as the connector post is received within the cavity such that the connector post pushes the central plate in the second direction toward the engaged configuration.

9. The transformable building block of claim 8, wherein the central plate has a leg that protrudes from the opening, and wherein the leg has an angled surface configured to slide against a corresponding angled surface of the connector post.

10. The transformable building block of claim 8, wherein the base plate has a base, wherein the base defines an opening, and wherein the central plate extends through the opening of the base and then protrudes from the opening of the wall of the cavity.

11. The transformable building block of claim 5, wherein the body comprises a first section and a second section, wherein the first section and the second section are joined along curved and flanged joints, wherein the first section and the second section have edges that define a recess of the body, and wherein in the default configuration the appendage is stowed within the recess substantially flush with an outer surface of the body.

12. The transformable building block of claim 1, wherein the body defines a guide member, and wherein the central plate has a runner member that protrudes in the first direction and slides against the guide member.

13. A transformable building block comprising:

a body defining a storage cavity and a receiving cavity;

a post member having a protruding portion and a base portion, and being movably coupled to the body to move in a first direction;

a central plate moveably coupled to the body to move in a second direction transverse to the first direction; and an appendage moveably coupled to the body and connected to the central plate, wherein, in a default configuration of the transformable building block, the protruding portion is disposed in the storage cavity, the base portion is disposed within the receiving cavity at a first position, the central plate is disposed at a first inner position, and the appendage is stowed against the body, and wherein, in moving from the default configuration to an engaged configuration of the transformable building block, the protruding portion protrudes from the storage cavity, the base portion moves within the receiving cavity to a second position farther inside the body than the first position, the central plate is moved by the base portion to a second outer position outside of the first inner position, and the appendage is moved by the central plate to protrude away from the body.

14. The transformable building block of claim 13, wherein the base portion of the post member has a base disposed in the receiving cavity and a riser extending from the base to the protruding portion and extending through an opening of the body.

15. The transformable building block of claim 13, wherein as the base portion moves from the first position to the second position, the base portion pushes the central plate from the first inner position to the second outer position.

16. The transformable building block of claim 13, wherein the body defines an opening in a wall of the receiving cavity, and wherein a portion of the central plate extends through the opening in the wall and into the receiving cavity, and is configured to be pushed in the second direction by a portion of another building element inserted into the receiving cavity.

17. The transformable building block of claim 13, wherein the appendage is connected to the central plate by a spring that is biased to pull the appendage stowed against the body.

18. A transformable building block comprising:

a body;

a post member having a base portion and a post portion, wherein the post member is movably coupled to the body to move along a first axis between a default position in which the post portion is disposed inside the body and an engaged position in which the post portion protrudes from the body;

a central plate movably coupled to the body to move along a second axis that is transverse to the first axis between a first inner position and a second outer position;

an appendage connected to the central plate, wherein as the post member moves from the default position to the engaged position, the base portion of the post member forces the central plate from the first inner position to the second outer position, and wherein as the central plate moves from the first inner position to the second outer position, the central plate moves the appendage from a first stowed position to a second protruding position.

19. The transformable building block of claim 18, wherein the body defines a cavity configured to receive a connector post, and wherein the base portion of the post member is disposed in the cavity and is configured to be pushed by the connector post as the connector post is received within the cavity to move the post member from the default position to the engaged position.

20. The transformable building block of claim 18, wherein the body defines a receiving cavity and an opening in a wall of the receiving cavity, and wherein a portion of the central plate extends through the opening in the wall and into the receiving cavity, and is configured to be pushed by a portion of another building element inserted into the receiving cavity to move the central plate toward the second outer position.

* * * * *